US008202172B1

(12) United States Patent
LeJeune

(10) Patent No.: US 8,202,172 B1
(45) Date of Patent: Jun. 19, 2012

(54) CHILD ROCKING TOY

(76) Inventor: Francis E. LeJeune, River Ridge, LA (US)

( * ) Notice: Subject to any disclaimer, the term of this patent is extended or adjusted under 35 U.S.C. 154(b) by 92 days.

(21) Appl. No.: 12/572,622

(22) Filed: Oct. 2, 2009

Related U.S. Application Data

(60) Provisional application No. 61/102,412, filed on Oct. 3, 2008.

(51) Int. Cl.
*A63G 13/06* (2006.01)
*A63G 31/00* (2006.01)

(52) U.S. Cl. ..... 472/102; 472/134

(58) Field of Classification Search ..... 472/14, 472/25, 106, 108, 134, 95, 102; 297/245, 297/247, 270.5
See application file for complete search history.

(56) References Cited

U.S. PATENT DOCUMENTS 1,283,210 A 10/1918 Kinney
1,395,698 A 11/1921 Baum et al.
1,712,703 A 5/1929 Hudson
2,467,338 A 4/1949 Sellards
2,804,123 A 8/1957 Kling
2,826,424 A 3/1958 Erickson
2,862,710 A 12/1958 Lewis
2,878,858 A * 3/1959 Winchester ..... 472/25
3,084,935 A 4/1963 Brown
3,110,047 A 11/1963 Bringman
3,586,321 A 6/1971 Gehrke et al.
3,612,520 A * 10/1971 Chang et al. ..... 482/71
3,649,007 A 3/1972 Thomas
3,716,880 A 2/1973 Sorenson
4,613,131 A 9/1986 Anderson
5,951,403 A * 9/1999 Trzos ..... 472/25
6,709,340 B2 * 3/2004 Gordon ..... 472/134

* cited by examiner

*Primary Examiner* — Kien Nguyen
(74) *Attorney, Agent, or Firm* — Garvey, Smith, Nehrbass & North, L.L.C.; Charles C. Garvey, Jr.; Vanessa M. D'Souza

(57) ABSTRACT

A child's rocking toy provides a body, the body having a lower convex surface and an upper concave surface with a peripheral edge. The upper concave surface has a lower portion with a seat and a seating surface. A handle, handles or a steering wheel is mounted to the upper concave surface at a position next to the peripheral edge. The seating surface is placed in a position well below the peripheral edge and closer to the bottom of the body.

12 Claims, 3 Drawing Sheets

CHILD ROCKING TOY

CROSS-REFERENCE TO RELATED APPLICATIONS

Priority of U.S. Provisional Patent Application Ser. No. 61/102,412, filed Oct. 3, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to children's rocking toys. More particularly, the present invention relates to a disk shaped rocking toy having an outer convex surface that engages an underlying surface such as a floor and an upper concave surface that is receptive of the body of a child and wherein a lower portion of the concave side of the disk provides a seat and an upper periphery of the disk concave side provides a steering wheel.

2. General Background of the Invention

There are many types of toys for children that employ a rocking action when the child is mounted upon or is riding the toy. Examples include a common rocking horse. Examples of such toys are seen in the following table, some of which are a disk shaped toy having an outer convex surface and an upper, inner concave surface that has a seat.

The following possibly relevant U.S. Patents are incorporated herein by reference:

TABLE

| U.S. Pat No. | TITLE | ISSUE DATE |
|---|---|---|
| 1,283,210 | Mechanical Movement Exerciser | Oct. 29, 1918 |
| 1,395,698 | Combined Rocking and Revolving Chair | Nov. 1, 1921 |
| 1,712,703 | Amusement and Exercising Device | May 14, 1929 |
| 2,467,338 | Amusement Apparatus | Apr. 12, 1949 |
| 2,804,123 | Rocking and Rotating Toy | Aug. 27, 1957 |
| 2,826,424 | Coasting Device or Sled | Mar. 11, 1958 |
| 2,862,710 | Rocking and Swinging Toy | Dec. 2, 1958 |
| 3,084,935 | Children's Ride Device | Apr. 9, 1963 |
| 3,110,047 | Aqua Bowl | Nov. 12, 1963 |
| 3,586,321 | Balancing and Exercising Device | Jun. 22, 1971 |
| 3,649,007 | Wheel-Type Exercise Device | Mar. 14, 1972 |
| 3,716,880 | Circular Water Skis or Surfboard | Feb. 20, 1973 |
| 4,613,131 | Exercise Device for Physical Therapy | Sep. 23, 1986 |

BRIEF SUMMARY OF THE INVENTION

The present invention provides a child's rocking toy that employs a body that can be circular in shape, having opposed surfaces that include a lower convex surface and an upper concave surface. The body provides a peripheral edge.

The upper concave surface has a lower portion with a seat providing a seating surface for a child.

A steering wheel is mounted to the upper concave surface at a position next to the peripheral edge.

The seating surface is placed in the lower one quarter of the body, and at a position well below the peripheral edge and closer to the bottom of the body. In this fashion, a child that sits upon the seating surface provides a lower center of gravity that enables the child to rock the toy from side to side while occupying the seat. During such rocking, the convex lower surface engages an underlying support surface such as a floor.

In one embodiment, the body can be made of a buoyant structure such as wood, foam, styrofoam, polymer, plastic, or fiberglass. The body can be hollowed so that an air chamber or chambers provide all or part of the buoyancy.

The body can be of a double hull arrangement such as of polymer, fiberglass or plastic and filled with air or foam.

The body can be of any material that is employed in the construction of surfboards, kayaks, or boats.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
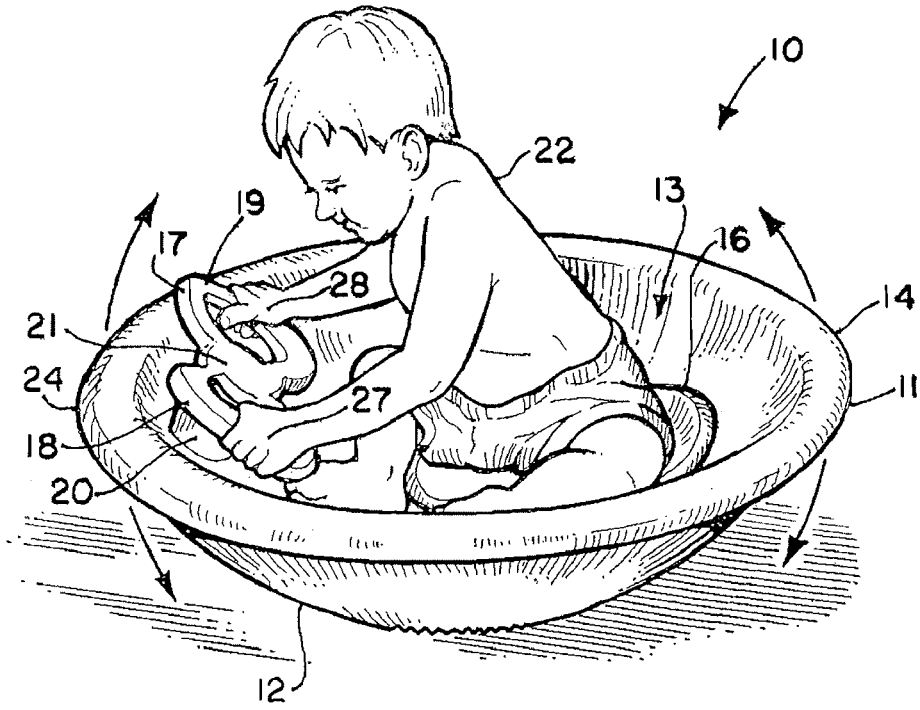
FIG. 1 is a top perspective view of the preferred embodiment of the apparatus of the present invention.

FIGS. 1-6 show the preferred embodiment of the apparatus of the present invention, designated generally by the numeral 10. Child's rocking toy 10 provides a body 11 that can be circular when viewed in plan view. The body 11 provides a lower surface that is a convex surface 12. The body 11 provides an upper surface that is an upper concave surface 13. A peripheral edge 14 is provided that can provide an inwardly or outwardly extending lip 24.

A lower portion 15 of the concavity 13 provides seat 16. The seat 16 can be contoured to conform to the child's body. Preferably, the seat 16 is located in the one half (½) or lower one quarter (¼) of the body 11. The seat 16 provides a seating surface 25 that is preferably well below lip 24 and upper surface 26 of body 11, and preferably below steering wheel 17.

Figure 2:
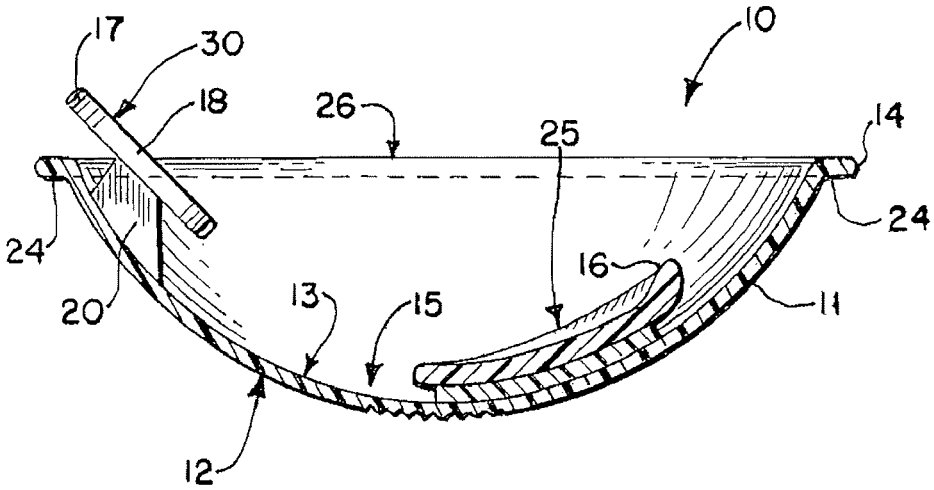
FIG. 2 is a sectional view of the preferred embodiment of the apparatus of the present invention.

A steering wheel 17 is mounted to body 11 next to peripheral edge 14. The steering wheel 17 can include a shaft or mount 20 that extends inwardly from upper concave surface 13 at a position next to lip 24. The steering wheel 17 provides a hub 21 mounted on shaft 20 at a position spaced away from body 11. The hub 21 supports handles 18, 19. Each handle 18, 19 is gripped during use by the hand of a child 22. For example, the child 22 grips handle 18 with his or her left hand 27. The child 22 grips the right handle 19 with his or her right hand 28. Handles 18, 19 can extend above and below upper surface 26 of body 11 as shown in FIG. 2. Upper surface 30 of steering wheel 17 can form an obtuse angle with surface 26 as seen in FIG. 2.

Figure 3:
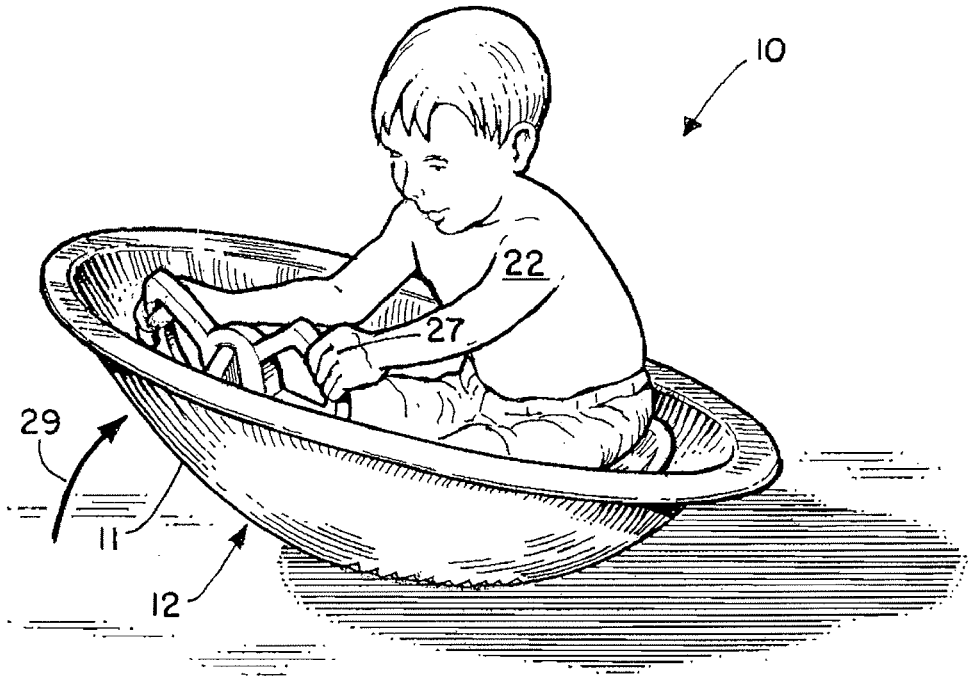
FIGS. 3-5 are perspective photograph views of the preferred embodiment of the apparatus of the present invention shown during use.
Figure 4:
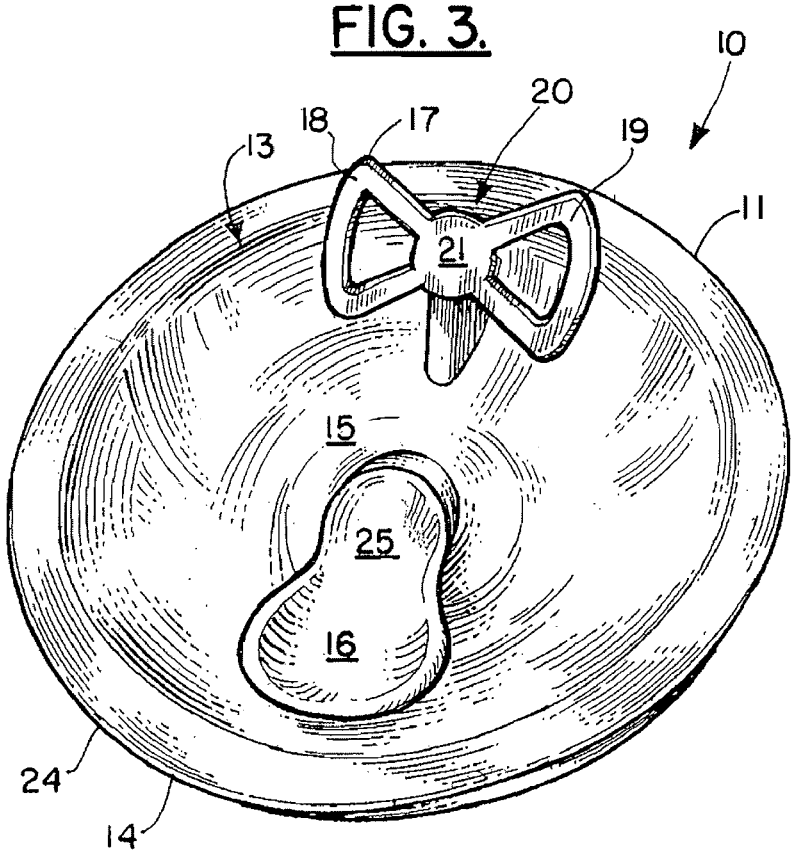
Figure 5:
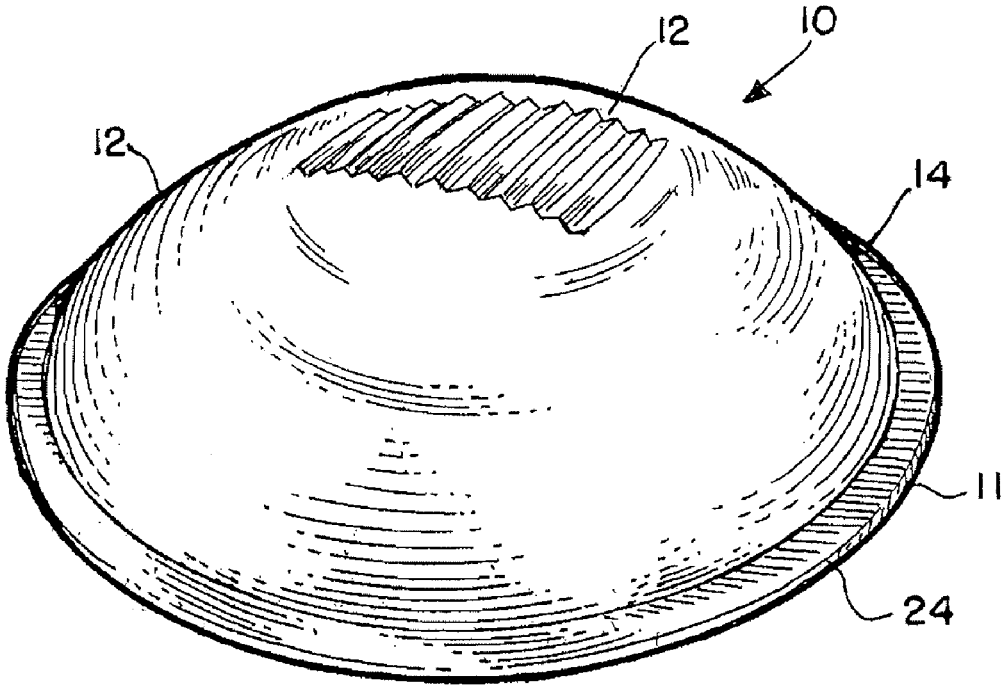

Once the child 22 assumes a position of sitting upon seating surface 25 of seat 16 and holding the handles 18, 19 of steering wheel 17, the child 22 is in a position that enables the body 11 to be rocked fore and aft or side to side or a combination thereof. In FIG. 3, arrow 23 illustrates that the child 22 is rocking forward. In FIG. 4, arrow 29 illustrates that the child 22 is rocking backwards.

The body 11, seat 16 and steering wheel 17 can be a buoyant structure (e.g. wood, plastic, styrofoam, fiberglass and can be hollowed) that would enable apparatus 10 to be used in a swimming pool. The body 11 could be hollowed having one or more air chambers, such as the type of construction used for boats and/or kayaks. In such a case, the lip 24 would always be at or above the water's surface. In such a situation, a child 22 using the rocking toy 10 would always wear a suitable and governmentally approved floatation device. The body 11 could be for example thirty inches in diameter and have a vertical height of about eight-nine inches. In a larger version, the body 11 could have a diameter of about forty inches and a vertical height of about ten inches as an example. The body lower convex surface 12 would be curved so that a child 22 could rock the body from side to side without tipping over. For example, the surface 12 could be the shape of a section of a sphere such as a partial spherical surface.

The following is a list of parts and materials suitable for use in the present invention.

PARTS LIST

| Part Number | Description |
|---|---|
| 10 | child's rocking toy |
| 11 | body |
| 12 | lower convex surface |
| 13 | upper concave surface |
| 14 | peripheral edge |
| 15 | lower portion of concavity |
| 16 | seat |
| 17 | steering wheel |
| 18 | handle |
| 19 | handle |
| 20 | shaft/mount |
| 21 | hub |
| 22 | child |
| 23 | arrow |
| 24 | lip |
| 25 | seating surface |
| 26 | upper surface |
| 27 | hand |
| 28 | hand |
| 29 | arrow |
| 30 | upper surface |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A child's rocking toy, comprising:

a) a body, the body having a lower convex surface and an upper concave surface with a peripheral edge;

b) the upper concave surface having a lower portion with a seat and a seating surface;

c) a steering wheel mounted to the upper concave surface with a steering wheel mount that spaces the wheel away from the concave surface, the wheel having gripping surfaces that extend above the peripheral edge; and d) wherein the seating surface is placed in a position well below the peripheral edge, at the bottom of the body.

2. The toy of claim 1 wherein the seating surface is in the lower half of the body.

3. The toy of claim 1 wherein the seating surface is in the lower third of the body.

4. The toy of claim 1 wherein the seating surface is in the lower quarter of the body.

5. The toy of claim 1 wherein the body is a buoyant structure.

6. The toy of claim 5 wherein the combination of body, seat and steering wheel provide a buoyant structure.

7. A child's rocking toy, comprising:

a) a body, the body having a lower convex surface and an upper concave surface with an upper peripheral edge and a bottom;

b) the upper concave surface having a seat and a seating surface at the bottom of the concave surface;

c) one or more handles mounted to the upper concave surface at a position next to the peripheral edge, the handles providing gripping surfaces for a user's hands, said gripping surfaces being spaced away from the concave surface with a mount; and d) wherein the seating surface is placed in a position well below the peripheral edge and closer to the bottom of the body.

8. The toy of claim 7 wherein the seating surface is in the lower half of the body.

9. The toy of claim 7 wherein the seating surface is in the lower third of the body.

10. The toy of claim 7 wherein the seating surface is in the lower quarter of the body.

11. The toy of claim 7 wherein the body is a buoyant structure.

12. The toy of claim 7 wherein the combination of body, seat and handles provide a buoyant structure.

* * * * *